United States Patent [19]

Granat et al.

[11] Patent Number: 4,732,289

[45] Date of Patent: Mar. 22, 1988

[54] TAMPER INDICATING CLOSURE MEMBER FOR CONTAINER

[75] Inventors: Rodney J. Granat, Caulfield; Roger W. Clark, Hampton Park, both of Australia

[73] Assignee: ACI Australia Limited, Australia

[21] Appl. No.: 891,756

[22] Filed: Jul. 31, 1986

[30] Foreign Application Priority Data

Jul. 31, 1985 [AU] Australia ..... PH01726
May 14, 1986 [AU] Australia ..... PH05893

[51] Int. Cl.[4] ..... B65D 41/34

[52] U.S. Cl. ..... 215/252; 215/31; 215/258

[58] Field of Search ..... 215/252, 258, 31

[56] References Cited

U.S. PATENT DOCUMENTS 4,156,490 5/1979 Peraboni ..... 215/252
4,196,818 4/1980 Brownbill ..... 215/252
4,352,436 10/1982 Chartier et al. ..... 215/252
4,417,666 11/1983 Roberts ..... 215/258 X
4,479,586 10/1984 Csaszar ..... 215/252 X
4,497,765 2/1985 Wilde et al. ..... 215/252 X
4,567,993 2/1986 Albrecht ..... 215/252
4,613,052 9/1986 Gregory et al. ..... 215/252

FOREIGN PATENT DOCUMENTS 0049876 4/1982 European Pat. Off. .
0117104 6/1984 European Pat. Off. .

*Primary Examiner*—Donald F. Norton
*Attorney, Agent, or Firm*—Merchant, Gould, Smith, Edell, Welter & Schmidt

[57] ABSTRACT

A tamper indicating closure member for containers is disclosed having a cap member with a top wall and a peripheral skirt integral therewith. Also included is a separable band portion interconnected to the skirt by a frangible bridge element. The band portion is capable of coacting with an axially inclined ramp surface defined by a circumferential bead on the neck, thereby substantially preventing transverse movement of the closure band portion relative to the container neck.

16 Claims, 4 Drawing Figures

TAMPER INDICATING CLOSURE MEMBER FOR CONTAINER

Figure 1:
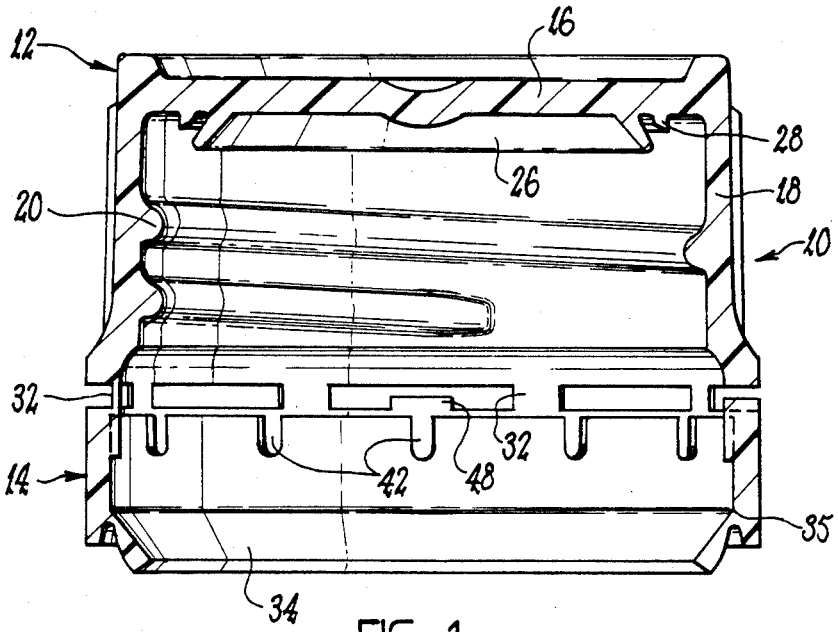

This invention relates to an improved closure member which has tamper indicating means such that it is visibly apparent when a container having such closure has been tampered with. The invention also relates to a container having such closure.

It is known in the art to provide a closure with interconnected annular band which is detachable from the closure upon first removal of the latter from a container. Such bands normally include co-operation means which engages with a portion of the neck of the container, thus restricting axial movement of the band from the neck of the container once placed in position. Difficulties have been encountered with the use of such tamper evident closures when used on containers manufactured within the limits of normal dimensional tolerances. It has been found that with variation of the container neck, within those tolerances, there can be either difficulty in placing the closure over the top of the container if the diameter of the container neck is too large. Alternatively, once fitted, the closure may be able to be removed from the container without severing the band portion if the diameter of the container neck is too small. In the past this difficulty due to variation within normal tolerances has necessitated the utilization of expensive manufacturing methods for containers to be used with such closure members.

It is an object of the present invention to provide an improved closure member which is suitable for use with containers, such as but not limited to glass containers, and which has a band portion which facilitates its intended functioning despite variation in dimensions of the container neck within normal manufacturing tolerances.

According to the invention, there is provided, for a container, a closure member having a cap member defining a top wall and a depending peripheral skirt integral with the top wall; an axially spaced, separable band portion interconnected by at least one frangible bridge element to an edge of the skirt remote from the top wall and integrally formed on said band portion a locating member adapted to be received behind a shoulder defined by the container neck; the band portion having centralizing means provided on its inner surface, at circumferentially spaced locations around that surface, the centralizing means being adapted to coact with an axially inclined ramp surface defined by a circumferential bead provided on the neck of the container such that notwithstanding variations in neck diameter within normal tolerances, the closure once fully applied to the container is centrally located on the container neck with the centralizing means contacting or being closely adjacent the bead and thereby substantially preventing transverse movement of the closure band portion relative to the container neck.

The skirt wall is preferably provided on an inner surface thereof with a screw thread for threaded co-operation with the neck of a container. However, the cap member may be provided with any other retention means as are known in the art for securing the cap member onto the top of the container.

In one arrangement, primarily intended for use with glass containers, on the under surface of the top wall of the cap member has an annular sealing fin and an annular abutment. The fin and abutment preferably are substantially concentric with the abutment radially spaced from said sealing fin such as radially outwardly of the latter. The abutment and sealing fin are arranged so that application of the closure member onto a container causes the sealing fin to be deflected or deformed by engaging the end rim of the container, thereby pushing the sealing fin up against the abutment to form a seal both with the abutment and the container rim.

In an alternative arrangement, primarily intended for containers of plastics materials, the inner surface of the top wall of the closure is simply provided with an annular sealing fin. In that alternative arrangement, the sealing fin has an external diameter related to the diameter of the inner circumferential surface of the neck of a container with which the closure is to be used such that, on application of the closure to the container, the sealing fin is received into the neck of the container and provides a fluid tight seal around that inner surface. Preferably the external surface of the sealing fin is of frusto conical form and increases in diameter toward the top wall, so that the tightness of the seal achieved between the fin and the inner surface of the neck of the container increases as the closure is applied to the container.

The band portion is of an annular configuration and is adapted to be received around the neck of a container. Preferably the band portion is of greater internal diameter than the cap member such that, upon fitting the closure member onto a container, the band portion can quite easily pass over the thread or other means provided on the container for engaging the cap member. The band portion has an integrally connected locating member which is adapted to be received behind a shoulder defined on the container neck. Preferably the locating member is a continuous annular flap which is concentric with the band portion and, as formed, is initially directed radially inwardly and axially away from the cap member. In such embodiment the neck of the container preferably has a ramp portion which portion is intermediate the top of the container neck and the shoulder behind which the locating member is to be received. In such embodiment the annular flap may be hingedly connected to the inner surface of the band portion and such that, upon initial tightening the closure member onto the container, an edge of the annular flap remote from the cap member abuts onto the ramp portion of the container neck and upon further tightening the annular flap is caused to "flip" over to an operating orientation such that the flap moves about its hinge and then projects radially inwardly but axially towards the cap member. Upon still further tightening of the closure member the annular flap is moved so as to be received behind the shoulder on the neck of the container. In a preferred, alternative arrangement, the annular flap may be flipped over to such orientation before application of the closure to a container.

In other arrangements, the locating member can be a portion of reduced diameter defining an annular shoulder or may be comprised of resilient finger-like protrusions circumferentially spaced around the inner face of the band portion so that the end of said fingers similarly abut behind the shoulder on the container neck.

Located on the inside face of the band portion there is provided centralizing means. The centralizing means is adapted to coact upon the neck of the container in order to ensure a neat fit of the band portion around the neck of the container and to prevent slippage of the locating means from behind the container neck shoulder by lateral displacement of the band portion.

Preferably the centralizing means is provided by a number of lugs which are uniformly circumferentially spaced around the inner surface of the band portion. These lugs are preferably located towards the top of the band portion, commencing substantially adjacent to the link means and extending away from the cap member, but preferably not continuing so far as to reach the hinge of the locating member.

The closure of the invention preferably has a locating member of the above described form of an annular flap or of circumferentially spaced protrusions. In each case, the centralizing means most preferably terminate short of the lower edge of the band portion such that the centralizing means does not prevent the locating member, when in its operating orientation and with the closure applied to a container, from being able to contact the inner surface of the band portion.

The internal diameter of the locating member, when in its operating orientation in the case of an annular flap or when similarly oriented in the case of circumferentially spaced protrusions, preferably is greater than the diameter of the thread finish of the closure. Also, in each case, it is more preferable that the overall axial relationship of the closure and its band portion are such that two conditions are achieved. The first of these conditions is that, on application of the closure to a container, the thread of the closure is able to commence its threaded engagement with the thread of the container neck before the locating member first engages the ramp portion of the container neck with which the centralizing means substantially prevents lateral movement of the closure. The ramp portion most preferably is defined by a bead which also defines the shoulder behind which the locating member is received. The second condition is that the locating member, again on application of the closure, locates behind that shoulder after the container neck engages the sealing fin to achieve a seal. Thus, where a seal is achieved by the neck rim deflecting or deforming the sealing fin to push the latter against the abutment, the locating member is to engage behind the shoulder after the sealing fin has been pushed to seal against the abutment. Where the seal is achieved by the sealing fin being received into the container neck, the locating member is to engage behind the shoulder after such seal is achieved.

The at least one bridge element which interconnects the skirt of the cap member and the band portion may be of a variety of types. In one form, the at least one element comprises a frangible, circumferentially extending zone of reduced thickness joining the cap member to the band portion. In an alternative form, there is a plurality of circumferentially spaced bridge elements, each extending axially between and joining the cap member to the band portion.

In the alternative form of a plurality of circumferentially spaced bridging elements, the closure preferably includes abutment means for protecting the elements against breaking both during application of the closure to a container and during ejection of a formed closure from its moulding die. The abutment means may comprise a plurality of axially extending protrusions spaced around the edge of the skirt to which the band portion is connected. The protrusions are of lesser axial extent than the bridge elements. On application of an axial or rotational force to the closure which acts to draw the band portion toward the edge of the skirt, the protrusions engage the opposed edge of the band portion and thereby limit the extent of such drawing and, hence, of the force exerted on the bridge elements. In an alternative form, the protrusions may be provided around the opposed edge of the band portion, so as to similarly engage the edge of the skirt.

When a closure member of the type described is fitted to a container neck, the locating member is received behind the shoulder defined on the neck of the container. Upon tightening of the cap member onto the container to achieve this locating the centralizing means engages the ramp portion and, upon further tightening, draws the cap member centrally around the container neck. Once the closure member has been fitted to the neck of a container, unscrewing the closure for the first opening of the container is resisted by the locating member and is possible only be severing the bridge elements between the cap member and the band portion. The arrangement most preferably is such that, upon returning the closure to the container, the severing is visibly apparent, thereby indicating a previous opening of the container. Preferably on severing of the bridge elements the band portion is able to fall away from the closure to make that severing visible even when the cap member is returned.

The closure member of this invnetion is most conveniently formed of a suitable synthetic plastics material, such as by injection moulding.

Reference now is made to the accompanying drawings, in which

Figure 2:
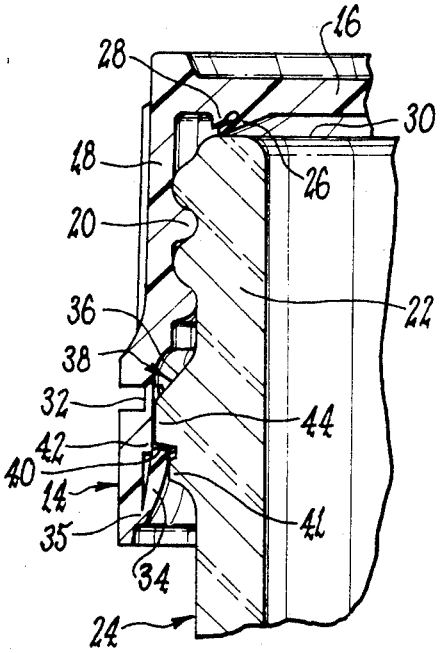
Figure 3:
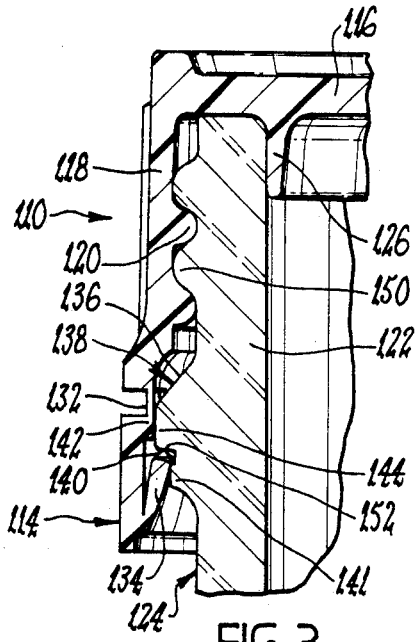
Figure 4:
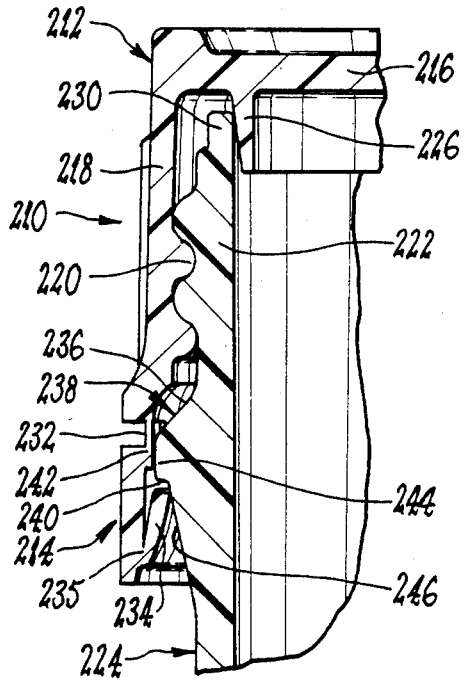

FIG. 1 has a cross-sectional view of a closure member according to the invention and suitable for a glass container FIG. 2 is an enlarged sectional view showing the member of FIG. 1 when fitted to the neck of a glass container;

FIG. 3 corresponds to FIG. 2 but shows an alternative form of closure according to the invention, also with a glass container;

FIG. 4 shows a variant of the closure of FIG. 3 as fitted to a plastics container.

In the particular embodiment shown in FIGS. 1 and 2, the closure member 10 has a cap member 12 and a band portion 14. The cap member 12 has a top wall 16 with a depending peripheral skirt wall 18. The skirt wall 18 is provided with a thread portion 20 on its inner face for tightening engagement with the neck 22 of a container 24 (shown in FIG. 2).

An annular sealing fin 26 is located on the under side of top wall 16 of the cap member and is concentric with an annular abutment 28 which is radially outwardly disposed from sealing fin 26. As can be seen in FIG. 2, abutment 28 and sealing fin 26 are arranged such that application of closure member 10 onto container 24 forces sealing fin 26 against the open ended rim 30 of container 24, thereby both with abutment 28 and container rim 30.

Band portion 14 is interconnected with cap member 12 by frangible link means or bridge elements 32. Band portion 14 has an annular flap 34 hingedly connected at hinge lines 35 adjacent its edge remote from cap member 12; flap 34 as formed being directed radially inwardly, and axially away from cap member 12, as can be seen in FIG. 1. Upon closure member 10 being received onto neck 22 of container 24, annular flap 34, if still in that orientation, engages on a ramp portion 36 of container neck 22 defined by peripheral bead 38. Upon tightening of the closure member 10, annular flap 34 is received behind shoulder 40 located on neck 22 of container 24 and also defined by bead 38. However, flap 34 preferably is caused to flip over to its in use orientation before application of member 10 to container 24, by application of a suitable tool.

Immediately below bead 38, there is a further bead 41 adjacent shoulder 40. Bead 41 is of lesser diameter than bead 38, and limits the extent to which flap 34 is able to move radially inwardly on passing over bead 38. The edge of flap 34 remote from its hinge line 35 thus is held in position for engaging shoulder 40, between band portion 14 and bead 41.

Band portion 14 has a number of lugs 42 which are uniformly spaced around its inner surface. These lugs are located towards the top edge of band portion 14 commencing substantially adjacent to link means 34. Lugs 42 extend axially on the inner surface of band portion 14, but are of lesser axial extent than that surface and do not extend as far as the hinge of annular flap 34. As can be seen in FIG. 2, once closure 10 has been fitted onto neck 22 of container 24 and fully tightened, lugs 42 contact or are spaced slightly from the peripheral face 44 of the bead 38, intermediate ramp 36 and shoulder 40, and thus prevent closure member 10 from being removed from the container neck 22 without severing link means 32.

It will be seen that, once closure member 10 has been fitted to neck 22 of container 24, unscrewing closure member 10 for the first time will be resisted by the annular flap 34 as it abuts onto shoulder 40. Furthermore closure member 10 cannot be removed, without severing link means 32 due to the uniform abutment of lugs 42 onto the face 44 of bead 38 as transverse movement of band portion 14 relative to container neck 22 is substantially prevented. The arrangement preferably is such that, upon cap member 12 being returned to container neck, the severing of the link means 32 is clearly visible.

In the embodiment of FIG. 3, the same reference numerals plus 100 are used for corresponding parts. In cap member 112, the under surface of top wall 116 has only an annular sealing fin 126. Also, the latter is positioned and of a diameter such that its frusto conical external surface engages around the inner surface of container neck 122. As closure member 110 is fully applied to neck 122, a fluid tight seal is achieved between fin 126 and that surface of neck 122.

Band portion 114 has a plurality of circumferentially spaced lugs 142, similar to lugs 42 of FIGS. 1 and 2. However, in the arrangement of FIGS. 1 and 2, lugs 42 are of a length such that, with flap 34 in its operating orientation as shown in FIG. 2, a partial overlap occurs. With variation in neck finish tolerances, this overlap can make it difficult to draw flap 34 past bead 38 to locate below shoulder 40 unless there is sufficient resilience in the material comprising band 14, its lugs 42 and flap 34. The arrangement of FIG. 3 therefore is preferred, this showing lugs 142 terminating axially above flap 134 with the latter in its operating orientation such that flap 134 can deform on passing over bead 138 so that its outer surface contacts, or is closely adjacent to, the inner surface of band portion 114 below lugs 142.

Each of closure members 10,110 is shown in relation to a glass container, although closures according to the invention also can be suitable for plastics containers. Indeed, member 110 is a variant of a form of closure shown in FIG. 4 and primarily intended for use with a plastics container.

In FIG. 4, parts corresponding to those of FIG. 3 are shown with the same reference numeral plus 100. In this instance, there again is an annular fin 226 depending from the under side of top wall 216 of cap member 212. As in FIG. 3 with fin 126, fin 226 provides a fluid tight seal around the inner surface of neck 222 as closure member 210 is fully applied.

Closure 210 differs from closure 110 of FIG. 3 in that it does not include a further bead similar to bead 141. Rather, below shoulder 240 of bead 238, the outer surface of container neck 222 tapers downwardly and radially inwardly, as shown at 246. With a glass container as shown in FIGS. 2 and 3, it is found that band portion 14, 114 readily falls away after from beads 41,141 on severing of link means 32, 132 so that a positive tamper indication is provided. With a plastics container 224, a bead similar to beads 41,141 would be likely to be frictionally engaged by band portion 214 after severing of link means 232 so that such positive indication is not provided. However, a tapered neck finish as at 246 is found to ensure that band portion 214 does fall away as required, to provide a positive tamper indication.

Reverting to FIGS. 1 and 2, it will be noted that, between some link means 32, band portion 14 is provided with a respective one of about four protrusions 48. Corresponding protrusions are similarly provided in closures 110 and 210. While, in each case, the protrusions preferably are provided at the edge of the band portion nearest skirt wall 18, 118, 218, they alternatively may be provided on the adjacent edge of that wall and extend toward the band portion.

The protrusions 48 of closure 10, as with those of closures 110, 210, extend axially over part of the spacing between band portion 14 and skirt wall 18. That is, they are of lesser axial extent than the link means 32. During application of closure 10 to a container, the axial and rotational force applied to closure 10 causes link means 32 to flex or deflect so as to reduce the spacing between portion 14 and wall 18. If not limited, such flexing is likely to rupture link means 32, preventing portion 14 from serving its intended purpose. Limitation of such flexing is provided by protrusions 48, the latter being caused to engage the adjacent edge of skirt wall 18 and thereby prevent further transference of forces to link means 42. Protrusions 48 also serve a similar function during ejection of closures 10,110,210 from forming dies.

In the embodiment of FIGS. 1 and 2 (as well as those of FIGS. 3 and 4), flap 34 (134,234) when in its operating orientation shown in FIG. 2 preferably has an inner diameter which is larger than that of thread finish of the closure, i.e. larger than the diameter of thread 20 (120). Also, it is preferred that the overall arrangement in each embodiment is such that, on application of the closure to container neck 22 (122,222), thread 20 (120,220) commences its threaded engagement with the thread of neck 22 (122,222) before flap 34 (134,234) hits ramp portion 36 (136,236) of bead 38 (138,238). Additionally, the overall arrangement of FIGS. 1 and 2 preferably is such that fin 26 is deformed to provide a seal against abutment 28 before flap 34 passes below shoulder 40 of bead 38; while in each of FIGS. 3 and 4, the overall arrangement preferably is such that fins 126,226 also provide a seal in neck 122,222 before flap 134,234 passes below shoulder 140,240.

The arrangement of lugs 42 shown in FIG. 1 is similar to that of FIGS. 3 and 4. There may be from about six to fourteen of the lugs, such as about 12, at substantially uniformly spaced circumferential locations. The lugs are relatively slight in circumferential and radial dimension; being of the order of 1 to 2 mm circumferentially and 0.2 to 1.0 mm radially. The lugs thus are readily able to be compressed as their band portion passes across ramp portion 36 (136,236) to locate the lugs 42 (142,242) in contact with or closely adjacent face 44 (144,244) of the bead 38 (138,238). On assuming such position, resilient recovery of the material of which the closure members are made enhances the centering action provided by the lugs.

The Figures also illustrate improved neck finishes for containers which exhibit features which are complementary to and co-operate with the closures of the invention. The similar neck finishes of FIGS. 2 and 3 are suitable for glass containers, while that of FIG. 4 is suitable for a plastics container.

As shown in FIG. 3, the glass finish of FIG. 3 has closure engaging means, here shown as comprising thread 150. Below thread 150, there is bead 138 as described above. Immediately below bead 138, the above-mentioned bead 141 is provided; the latter having an outerface which is substantially co-axial with neck 122 and of lesser diameter than bead 138. Also, beads 138,141 are spaced by a narrow groove 152. As will be understood from the foregoing, on unscrewing closure 110 from the container, flange 134 abuts against shoulder 140 of bead 138 to resist removal of the closure unless the applied force is sufficient to rupture bridge elements 132. Until such rupture occurs, flange 134 is closely constrained radially between band 114 and bead 141, but substantially co-axially with respect to neck 122 due to the centering action of lugs 142. Flange 134 can flare inwardly by resilient deformation to an extent permitted by groove 152, further facilitating its retention below shoulder 140. However, on rupturing of elements 132 and, if necessary, radially outward recovery of flange 134, band portion 114 then is free to drop away from bead 138 onto the narrower portion of neck 122 below bead 141 to provide a clear visual indication that the container has been opened.

In relation to FIG. 4, similar parts of the plastics neck finish have the same reference numeral as in FIG. 3, plus 100. In this instance, a bead below bead 238 is omitted; the finish exhibiting the frusto-conical surface 246 indicated above, without a groove spacing this from bead 238. However, such groove can be provided, if required.

Tapered surface 246 enables band portion 214 to freely fall away on rupturing of bridge elements 232. However, the wider diameter upper portion of surface 246 provides a similar action to that of bead 141 in FIG. 2. That is, the upper portion of surface 246 acts, prior to such rupturing, to ensure proper functioning of flange 234; surface 246 co-operating with band portion 214 and lugs 242 in this regard.

Finally, it is to be understood that various alterations, modification and/or additions may be introduced into the constructions and arrangements of parts previously described without departing from the spirit or ambit of the invention.

We claim:

1. A closure member for a container, the closure member having a cap member defining a top wall and a depending peripheral skirt integral with the top wall; and axially spaced, separable band portion interconnected by at least one frangible bridge element to an edge of the skirt remote from the top wall and integrally formed on said band portion a locating member adapted to be received behind a shoulder defined by the container neck; the band portion having a centeralizing means provided on its inner surface, at circumferentially spaced locations around that surface; the centralizing means being dimensioned radially of said inner surface, relative to a peripheral face defined by a circumferential bead provided on the neck of the container such that, notwithstanding variations in neck diameter within normal tolerances, the closure member once fully applied to the container is centrally located on the container neck with the centalizing means contacting or being closely adjacent said peripheral face of the bead and thereby substantially preventing transverse movement of the closure band portion relative to the container neck; said locating member comprising an annular flap hingedly connected to the inner surface of the bank portion and, in an operative orientation thereof, extending radially inwardly and axially toward said top wall; said annular flap being connected to said inner surface around a hinge line, the width of said flap from said hinge line being less than the spacing between said hinge line and said centralizing means such that the centralizing means does not impede pivoting of said flap.

2. A closure member according to claim 1, wherein said centralizing means comprises a plurality of lugs spaced circumferentially around said inner surface.

3. A closure member according to claim 2, wherein there are from six to fourteen said lugs substantially uniformly spaced around said inner surface.

4. A closure member according to claim 2, wherein said lugs extend axially from an edge of the band portion adjacent which the at least one bridge element is connected to the band portion, said lugs terminating short of the other edge of the band portion.

5. A closure member according to claim 2, wherein each of said lugs has a circumferential extent of from 1.0 to 2.0 mm and a radial extent of from 0.2 to 1.0 mm.

6. A closure member according to claim 1, wherein said at least one bridge element comprises a plurality of axially extending, circumferentially spaced bridge elements each extending between the skirt wall and said band portion.

7. A closure member according to claim 6, wherein one of adjacent edges of said skirt wall and band portion is provided with a plurality of axially extending, circumferentially spaced protrusions, each said protrusion terminating short of the other one of said edges and being adapted to engage said other edge on application of an axial or rotational force to said closure member and, by said engagement, to protect said bridge elements from being ruptured by said force.

8. A closure according to claim 1, in combination with a container having around the neck thereof a bead defining a shoulder below which said locating means is received; said centralizing being located around a peripheral face of said bead.

9. A closure member according to claim 8, wherein said top wall has on the under surface thereof an annular abutment and an annular sealing fin, said sealing fin being deformed by engagement with a rim surface of the container to provide a seal between said rim surface and annular abutment.

10. A closure member according to claim 8, wherein said top wall has on the under surface thereof an annular sealing fin, said sealing fin being received within and providing a seal, circumferentially of the neck of said container.

11. A closure according to claim 10, wherein said container neck immediately below said bead is tapered downwardly and inwardly to facilitate visible separation of said band portion from the cap member on severing of said at least one bridge element.

12. A closure member for a container, the closure member having a cap member defining a top wall and a depending peripheral skirt integral with the top wall; an axially spaced, separable band portion interconnected by at least one frangible bridge element to an edge of the skirt remote from the top wall and integrally formed on said band portion a locating member adapted to be received behind a shoulder defined by the container neck; the band portion having centralizing means provided on and around its inner surface; the centralizing means being dimensioned radially of said inner surface, relative to a peripheral face defined by a circumferential bead provided on the neck of the container such that, notwithstanding variations in neck diameter within normal tolerances, the closure member once fully applied to the container is centrally located on the container neck with the centralizing means contacting or being closely adjacent said peripheral face of the bead and thereby substantially preventing transverse movement of the closure band portion relative to the container neck; said locating member comprising an annular flap hingedly connected to the inner surface of the band portion and, in an operative orientation thereof, extending radially inwardly and axially toward said top wall; said annular flap being connected to said inner surface around a hinge line, the width of said flap from said hinge line being less than the spacing between said hinge line and said centralizing means such that the centralizing means does not impede pivoting of said flap.

13. A combination comprising a container and a closure, the container having a neck defining an opening and on which the closure is receivable, the closure having a cap member defining a top wall and a depending peripheral skirt integral with the top wall; an axially spaced, separable band portion interconnected by at least one frangible bridge element to an edge of the skirt remote from the top wall and integrally formed on said band portion a locating member adapted to be received behind a shoulder defined by the container neck; the band portion having centalizing means provided on its inner surface, at circumferentially spaced locations around that surface; the centralizing means being dimensioned radially of said inner surface, relative to a peripheral face defined by a circumferntial bead provided on the neck of the container such that, notwithstanding variations in neck diameter within normal tolerances, the closure once fully applied to the container is centrally located on the container neck with the centralizing means contacting or being closely adjacent said peripheral face of the bead and thereby substantially preventing transverse movement of the closure band portion relative to the container neck; said locating member comprising an annular flap hingedly connected to the inner surface of the band portion and, in an operative orientation thereof, extending radially inwardly and axially toward said top wall; said annular flap being connected to said inner surface around a hinge line, the width of said flap from said hinge line being less than the spacing between said hinge line and said centralizing means such that the centralizing means does not impede pivoting of said flap; said neck being characterised by a finish defining engagement means by which the closure can be releasably applied to the container, a pheripheral bead below said engagement means which defines an outwardly facing peripheral surface around which the centralizing means of the closure is positionable and a shoulder facing away from the engagement means behind which the closure locating member is locatable; said neck finish being further characterised by surface means below said bead which is of lesser diameter than said bead peripheral surface and which enables the closure band portion to drop away from the closure skirt on rupturing of the at least one bridge element.

14. A container according to claim 13 wherein said container is of glass and said surface means is defined by a bead of lesser diameter than said peripheral bead, said neck finish being of reduced diameter below said surface means defining bead.

15. A container according to claim 14 wherein the respective said beads are spaced by a groove.

16. A container according to claim 13 wherein said container is of a plastics material, said surface means being defined by a frusto-conical section of said neck which decreases in diameter from said bead to a lower reduced diameter section.

* * * * *